US005480750A

United States Patent [19]

Kawada et al.

[11] Patent Number: 5,480,750

[45] Date of Patent: Jan. 2, 1996

[54] ELECTROPHOTOGRAPHIC PROCESS AND ELECTROPHOTOGRAPHIC APPARATUS

[75] Inventors: Masaya Kawada, Kyoto; Koji Yamazaki; Shigenori Ueda, both of Nara; Toshiyuki Ehara, Yokohama; Hiroaki Niino, Nara, all of Japan

[73] Assignee: Canon Kabushiki Kaisha, Tokyo, Japan

[21] Appl. No.: 209,876

[22] Filed: Mar. 14, 1994

[30] Foreign Application Priority Data

Mar. 15, 1993 [JP] Japan ..... 5-078635

[51] Int. Cl.[6] ..... G03G 13/045

[52] U.S. Cl. ..... 430/31; 355/214

[58] Field of Search ..... 430/84, 54, 56, 430/30, 31; 355/214

[56] References Cited

U.S. PATENT DOCUMENTS 3,891,316 6/1975 Whited ..... 355/14

4,632,894 12/1986 Ohashi et al. ..... 430/84

5,124,732 6/1992 Manzer et al. ..... 346/154

*Primary Examiner*—John Goodrow

*Attorney, Agent, or Firm*—Fitzpatrick, Cella, Harper & Scinto

[57] ABSTRACT

There are provided an electrophotographic apparatus and an electrophotographic process featured by control satisfying a condition $\ln(n)\times\ln(S)/\ln(E)\leqq 19.0$ among the localized energy level density n in the photoconductive layer of an amorphous silicon photosensitive member employed in the electrophotographic apparatus, the electric field E applied to the photosensitive member, and the surfacial moving speed S thereof. Such control reduces the photocarriers remaining in the photoconductive layer and inducing the photomemory effect, thereby suppressing the influence of a remaining latent image on the latent image generated in a next step, and providing an image of high quality without the photomemory effect, within resulting in a loss in the charging efficiency.

10 Claims, 6 Drawing Sheets

ELECTROPHOTOGRAPHIC PROCESS AND ELECTROPHOTOGRAPHIC APPARATUS

BACKGROUND OF THE INVENTION

1. Field of the Invention

The present invention relates to an electrophotographic process and an electrophotographic apparatus, and more particularly to an electrophotographic process and an electrophotographic apparatus capable of alleviating photomemory effect.

2. Related Background Art

The amorphous silicon photosensitive member (hereinafter represented as a-Si photosensitive member) is widely used as an electrophotographic photosensitive member, particularly in a high-speed copying machine or a laser beam printer, because of its excellent properties such as high durability and high photosensitivity.

FIGS. 1 and 2 are schematic cross-sectional views showing representative structures of the a-Si photosensitive member. FIG. 1 illustrates so-called single-layer photosensitive member in which the functions of the photoconductive layer are not separated, while FIG. 2 illustrates a function-separated photosensitive member in which the photoconductive layer is separated into a charge generating area and a charge transporting area.

The a-Si photosensitive member shown in FIG. 1 is provided, on a conductive substrate 201 such as aluminum, and, in succession, a charge injection blocking layer 202, a photoconductive layer 203 and a surface layer 204. The charge injection blocking layer 202, for suppressing the charge injection from the conductive substrate 201 into the photoconductive layer 203, is provided when necessary.

The photoconductive layer 203 is composed of an amorphous material containing at least silicon atoms, and shows photoconductivity. The surface layer 204 contains silicon atoms and carbon atoms (additionally containing hydrogen atoms and/or halogen atoms if necessary), and has the functions of suppressing charge injection from the surface, improving durability and stabilizing electrophotographic image.

In the a-Si photosensitive member shown in FIG. 2, the photoconductive layer 203 is functionally separated at least into a charge transfer area 206 composed of an amorphous material at least containing silicon atoms and a charge generating area 205 composed of an amorphous material at least containing silicon atoms, said areas being laminated in succession. When this photosensitive member is irradiated with light, the carriers principally generated in the charge generating area 205 move to the conductive substrate 201 through the charge transfer area 206.

FIG. 3 is a schematic cross-sectional view of the principal part of an electrophotographic apparatus employing an a-Si photosensitive member.

There are illustrated a cylindrical a-Si photosensitive member 301; a main charger 302; image information exposure 303; a blank exposure light source 307 for eliminating the charge on the surface of the photosensitive member, corresponding to the gap between the recording materials; a developing unit 304 for developing electrostatic latent image; a cleaning device 305; and a main charge eliminating light source 306, which are positioned in the vicinity of the photosensitive member 301 and in succession along the rotating direction thereof.

In the illustrated electrophotographic apparatus, the photosensitive member 301 rotated at a constant speed in a direction X is surface charged uniformly by the main charger 302, and is subjected to the exposure 303 of image information by image information providing means (not shown) for forming an electrostatic latent image, which is developed by the developing unit 304. A recording material (not shown) is subsequently brought into contact with the photosensitive member 301, is then transported through a transfer charger for transferring the thus developed image onto said recording material and a fixing unit (not shown), and is discharged from the apparatus. An area of the photosensitive member 301, corresponding to the gap between the recording materials is subjected to charge elimination by the blank exposure light source 307, in order to prevent unnecessary deposition of developer onto the surface of the photosensitive member 301. Thereafter, the photosensitive member 301 is subjected to surface cleaning by the cleaning device 305, and charge elimination by uniform exposure to the light of the main charge eliminating light source 306.

The a-Si photosensitive member 301 has various localized energy levels, thereby capturing a part of the photocarriers and reducing the mobility thereof or lowering the probability of recombination of the photocarriers. Consequently, in the electrophotographic apparatus as explained above, among the photocarriers generated by the light of image information exposure 303 and of blank exposure light source 307, those remaining inside the photosensitive member until the next charging step may be liberated from the localized levels at said charging step or thereafter, thereby generating a difference in the surface potential of the a-Si photosensitive member 301 between the exposed and non-exposed areas, thus eventually causing an image unevenness resulting from the photomemory effect.

In order to erase such photomemory, there is provided the main charge eliminating light source 306, but an excessively high erasing ability will result in other drawbacks such as difficulty in securing charge-ability and loss in potential shift. For this reason there is usually employed an LED array, capable of precisely controlling the wavelength and amount of the light for charge elimination.

Also, the blank exposure light source 307 is composed of an LED array, in consideration of high-speed response and control of the light-emitting area.

Further, for reducing the photomemory property of the a-Si photosensitive member, there may be employed a method of doping the photoconductive layer with atoms of Group III of the periodic table, thereby intentionally increasing the density of shallow localized energy levels and thus decreasing the substantial photomemory effect.

However, if there is a change in the condition of use of the photosensitive member in the electrophotographic apparatus, such as the electric field applied to the photosensitive member, the surface moving speed thereof, or the cause of photomemory, the above-explained countermeasure for the photomemory effect by the erasure with the main charge eliminating light source 306 or by the doping of the photoconductive layer with the atoms of Group III of the Periodic Table may result in a loss in the charging efficiency or in a potential shift phenomenon which is a gradual potential shift at the position of the developing unit 304 under same conditions of use.

SUMMARY OF THE INVENTION

In consideration of the foregoing, an object of the present invention is to provide an electrophotographic apparatus not associated with photomemory effect and capable of providing an image of high quality in all aspects.

Another object of the present invention is to provide an electrophotographic apparatus employing a photosensitive member provided at least with an amorphous photoconductive layer containing at least silicon and hydrogen and/or halogen atoms, and provided, in the vicinity of said photosensitive member, at least with a main charge eliminating light source, a main charger, an image exposing light source and/or a blank exposure light source, wherein a value A defined by the following equation (1) is adjusted to 19.0 or lower.

Still another object of the present invention is to provide an electrophotographic process employing a photosensitive member provided at least with an amorphous photoconductive layer containing at least silicon and hydrogen and/or halogen atoms, and effecting main charge eliminating exposure, main charging, imagewise exposure and/or blank exposure in this order, wherein the image recording is so conducted that a value A defined by the following equation (1) becomes equal to 19.0 or less.

The above-mentioned equation (1) is given as follows:

$$A=\ln(n)\cdot\ln(S)/\ln(E) \quad (1)$$

wherein n: density ($mm^{-3}$) of localized energy levels within a range d–0.95 eV in the photoconductive layer;

d: energy depth (eV) of possible thermal excitation of carriers within the time of movement of a given part of the photosensitive member from the source of photomemory (image exposure or blank exposure) to the main charger (in case of plural photomemory sources, the smaller one being taken);

E: electric field (V/mm) applied to the photosensitive member; and

S: moving speed (mm/sec) of the surface of the photosensitive member.

BRIEF DESCRIPTION OF THE DRAWINGS

FIGS. 1 and 2 are schematic cross-sectional views showing examples of structure of a-Si photosensitive member, wherein FIG. 1 illustrates a so-called single-layer photosensitive member in which the photoconductive layer is composed of a single layer, while FIG. 2 illustrates a function-separated photosensitive member in which the photoconductive layer includes a charge generating area and a charge transfer area;

DESCRIPTION OF THE PREFERRED EMBODIMENTS

According to the present invention, the electric field applied to the photosensitive member, the moving speed of the photosensitive member and the density of localized energy levels corresponding to these factors are suitably controlled to render the photocarriers less capturable, thereby increasing the mobility of the photocarriers and providing an image of high quality without the photomemory effect.

In the following, the present invention will be clarified in detail.

The present inventors have reached the present invention through intensive investigations on the relationship among the electric field applied to the photosensitive member, the moving speed thereof and the density of the localized energy levels.

Figure 3:
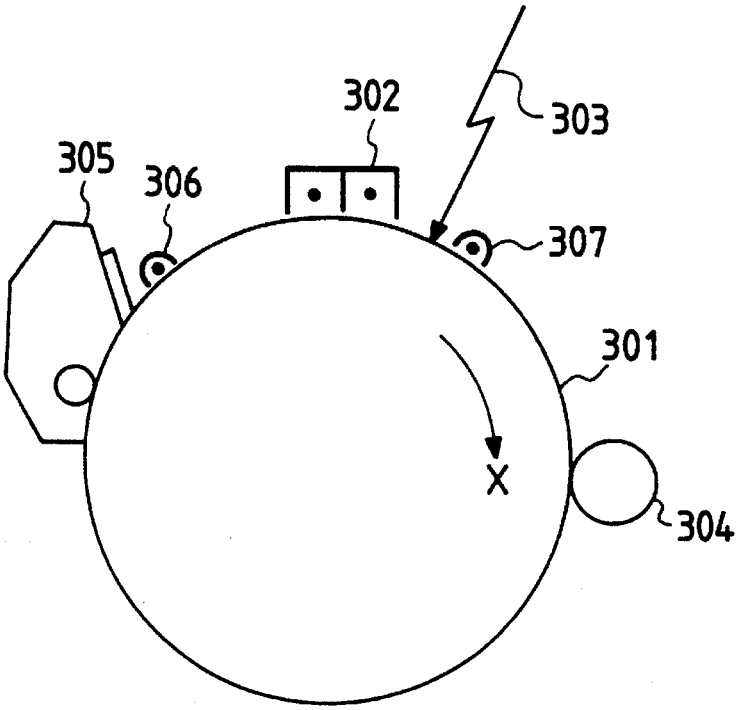
FIG. 3 is a view of an electrophotographic apparatus employing an a-Si photosensitive member.

The electrophotographic apparatus of the present invention, employing the a-Si photosensitive member, maintains the value A of the foregoing equation (1), which is defined by the electric field E applied to the photosensitive member, the moving speed S of the surface thereof and the density n of the localized energy levels in the photoconductive layer of the photosensitive member, at 19.0 or less through control of the parameters n, d, E and S, thereby reducing the capture of photocarriers generated by the image information exposure 303 and/or blank exposure shown in FIG. 3 and thus alleviating the photomemory effect, whereby the image quality is improved by the absence of increase in the amount of main charge eliminating exposure, namely by the absence of loss in the charging efficiency.

Figure 1:
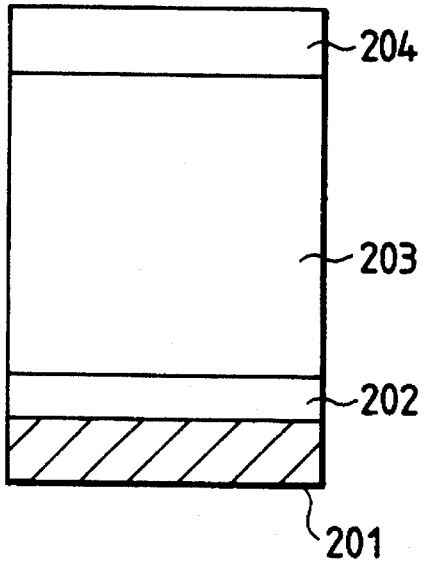
Figure 2:
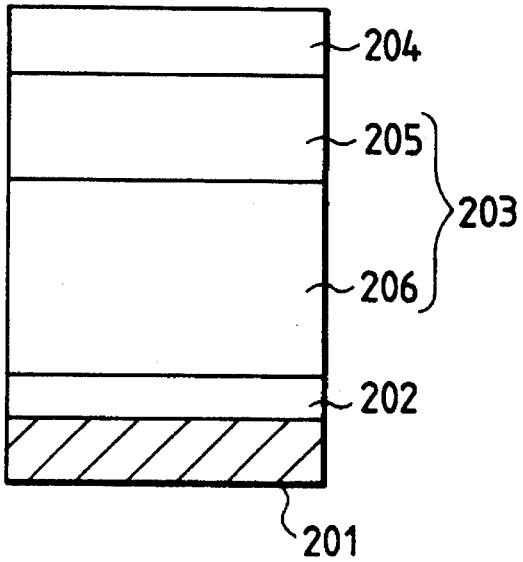

In particular, when the photoconductive layer is constructed as a so-called single layer structure as shown in FIG. 1, the object of the present invention can be attained and there can be at the same time attained higher image quality in the electrophotographic apparatus.

Besides, the content of the atoms of the Group III of the Periodic Table, contained in the above-mentioned photoconductive layer, is preferably maintained at 4 ppm or less, in order to further improve the charging efficiency and to increase the contrast.

Furthermore, the content of carbon atoms contained in the above-mentioned photoconductive layer is preferably maintained at 1% or less, in order to further reduce the parameter n in the equation (1), thereby being effective in further alleviating the photomemory effect.

[EXPERIMENTAL EXAMPLE ]

In the following there will be explained, with reference to the attached drawings, an experimental example which has lead to the derivation of the above-mentioned equation (1) of the present invention.

In the following experimental example and embodiments, the photomemory effect was measured in the following manner, with a modified apparatus NP6650 manufactured by Canon Co., Ltd.

Photomemory potential (Vm): In the configuration shown in FIG. 3, the photosensitive member 301 is rotated at a predetermined speed, and the charging current of the main charger 302 is so regulated that the dark potential of said photosensitive member 301 assumes a predetermined value at the position of the blank exposure 307, while the lighting voltage of the blank exposure light source 307 is so regulated that the light potential by the blank exposure at the blank exposure position 307 assumes a predetermined value. The blank exposure 307 is then repeatedly turned on and off at a cycle time corresponding to an A4-sized copy sheet, and the potential (VBon) is measured in an area of the photosensitive member 301, subjected to the irradiation of the blank exposure 307, at the position of the developing unit 304 after a rotation. Also the potential (VBoff) is measured in the same area of the photosensitive member 301, used for the measurement of VBon, at the position of the developing unit 304 while the blank exposure 307 is turned off, and the photomemory potential Vm is obtained by the difference in the potentials VBoff and VBon.

Blank exposure memory image: 10 A4-sized copies are prepared in succession from an intermediate tone original (Canon test chart FY9-9042-020), and the difference in density of the obtained images is measured.

Ghost image: 10 A4-sized copies are prepared in succession from an intermediate tone original (Canon test chart FY9-9042-020) and a ghost chart (Canon test chart FY9-9040-000) placed at a position of 30 mm from the rear end of the A4-sized original, and the difference in density of the obtained images is measured.

In the following experimental example and embodiments, a photosensitive member and sample were prepared in the following manner.

For preparing a photosensitive member, an aluminum cylinder constituting the substrate was degreased, washed and mirror finished. Also for preparing a sample, an insulating glass substrate was degreased and washed. The photosensitive member or the sample was prepared, employing the A1 cylinder or the glass substrate prepared as mentioned above, by high-frequency plasma CVD (RF-PCVD).

In the following, the apparatus for forming a deposition film by RF-PCVD and the method of formation will be briefly explained.

Figure 4:
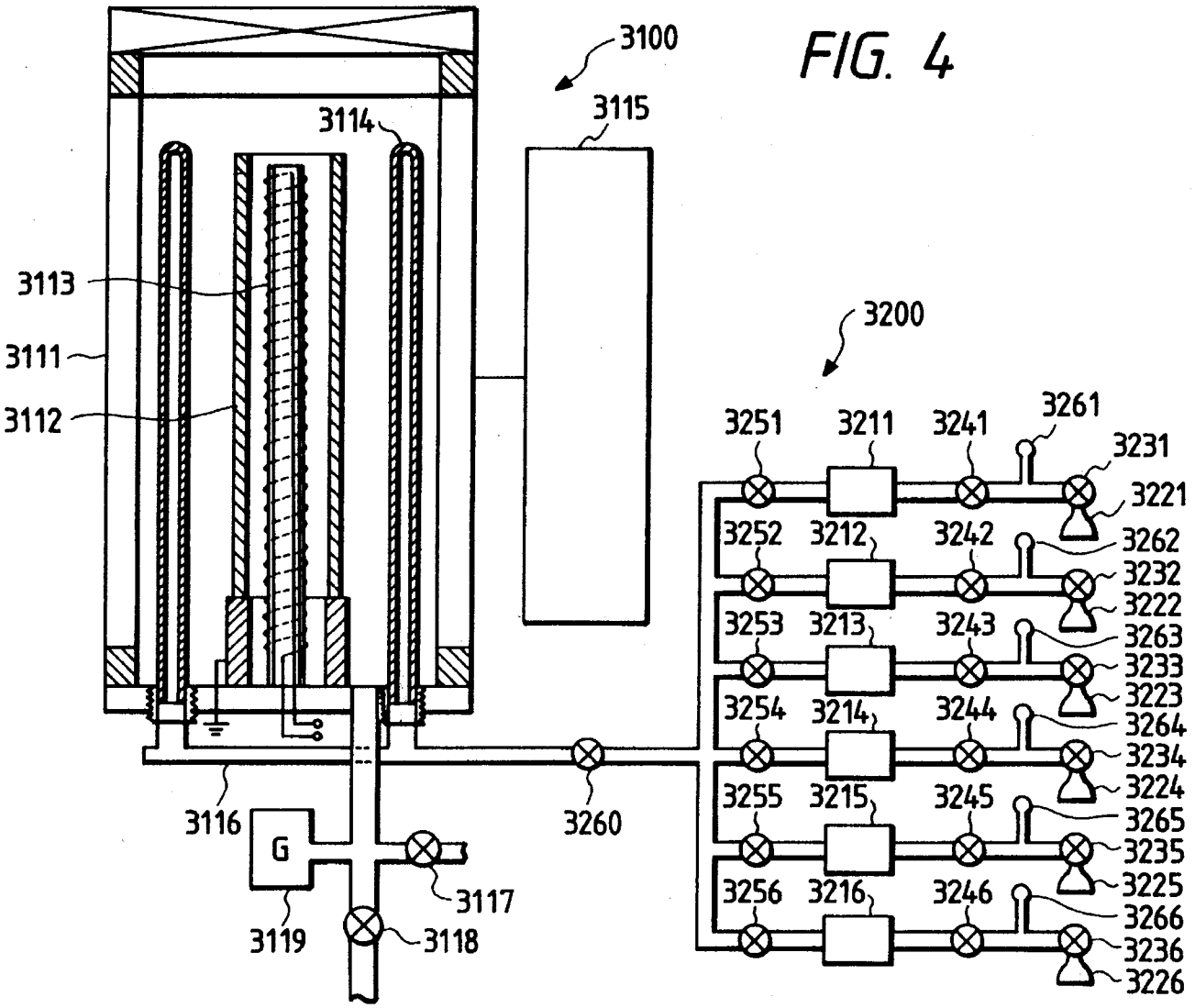
FIG. 4 is a schematic view of a film forming apparatus employed in the preparation of photosensitive members and samples.

FIG. 4 is a partially cross-sectioned view of an apparatus for producing the electrophotographic photosensitive member by the RF-PCVD method, composed of a deposition unit 3100, a raw material supply unit 3200, a vacuum unit (not shown) for evacuating a reaction chamber 3111 in the deposition unit 3100, an RF power source (not shown), and a matching box 3115.

In the reaction chamber 3111 there are provided a cylindrical substrate 3112, a substrate heater 3113, and a raw material gas introducing pipe 3114. The raw material gas supply unit 3200 is composed of containers 3221–3226 for raw material gasses such as $SiH_4$, $H_2$, $CH_4$, $NH_3$, $SiF_4$ etc., valves 3231–3236, in-flow valves 3241–3246, out-flow valves 3251–3256, and mass flow controllers 3211–3216, and the gas containers 3221–3226 are connected, through an auxiliary valve 3260, to the gas introducing pipe 3114 in the reaction chamber 3111.

The photosensitive member or the sample is prepared in this apparatus in the following manner, respectively employing an A1 cylinder as the cylindrical substrate, or a glass substrate fixed to a cylindrical support member.

When the cylindrical substrate 3112 reaches a predetermined temperature, the necessary ones among the out-flow valves 3251–3256 and the auxiliary valve 3260 are opened to introduce the gasses into the reaction chamber 3111, and the power of a mechanical booster pump (not shown) is so adjusted, according to the indication of a vacuum gauge 3119, that the internal pressure of the reaction chamber 3111 (hereinafter simply called the internal pressure) assumes a predetermined pressure below 1 Torr. After the internal pressure is stabilized, the RF power is introduced into the reaction chamber 3111 through the matching box 3115, and the RF power source is set at a desired power to induce RF glow discharge. This discharge decomposes the raw material gases in the reaction chamber 3111, thereby forming, on the cylindrical substrate 3112, a deposition film principally composed of predetermined amorphous silicon. After a desired film thickness is reached, the supply of the RF power is terminated, whereby the formation of the deposition film is completed.

A photosensitive member of a desired multi-layered structure is obtained by repeating similar operations.

The total thickness of the prepared photosensitive member is 29 μm (including a photoconductive layer of 25.5 μm), and the thickness of the sample is 1 μm.

[Experimental Example 1]

Samples for optical measurement and for electrical measurement were prepared.

Basic conditions for sample preparation included the use of $H_2$, $B_2H_6$ and $SiH_4$ mixed so as to attain ratios of $H_2/SiH_4$=1.7 and $B_2H_6/SiH_4$=0.55 ppm; an internal pressure of the reaction chamber of 0.57 Torr; a substrate temperature of 290° C.; an effective RF power of 500 W (hereinafter simply represented as RF power); and a deposition rate of 22.4 Å/sec.

In this experiment, the photoconductive layers or the samples were prepared by varying the RF power within a range of 400 to 600 W, while maintaining other conditions at the basic conditions mentioned above.

The prepared samples were subjected to the measurement of the localized level density n by the constant photocurrent method (CPM).

This CPM consists of irradiating the sample with monochromatic light, and measuring the amount of light providing a constant photocurrent at each wavelength, which allows one to obtain the localized level density n in somewhat deep energy levels.

In this example, the CPM measurement was conducted by forming a Cr comb-shaped electrode of a thickness of 1000 Å by evaporation, on each sample.

Figure 5:
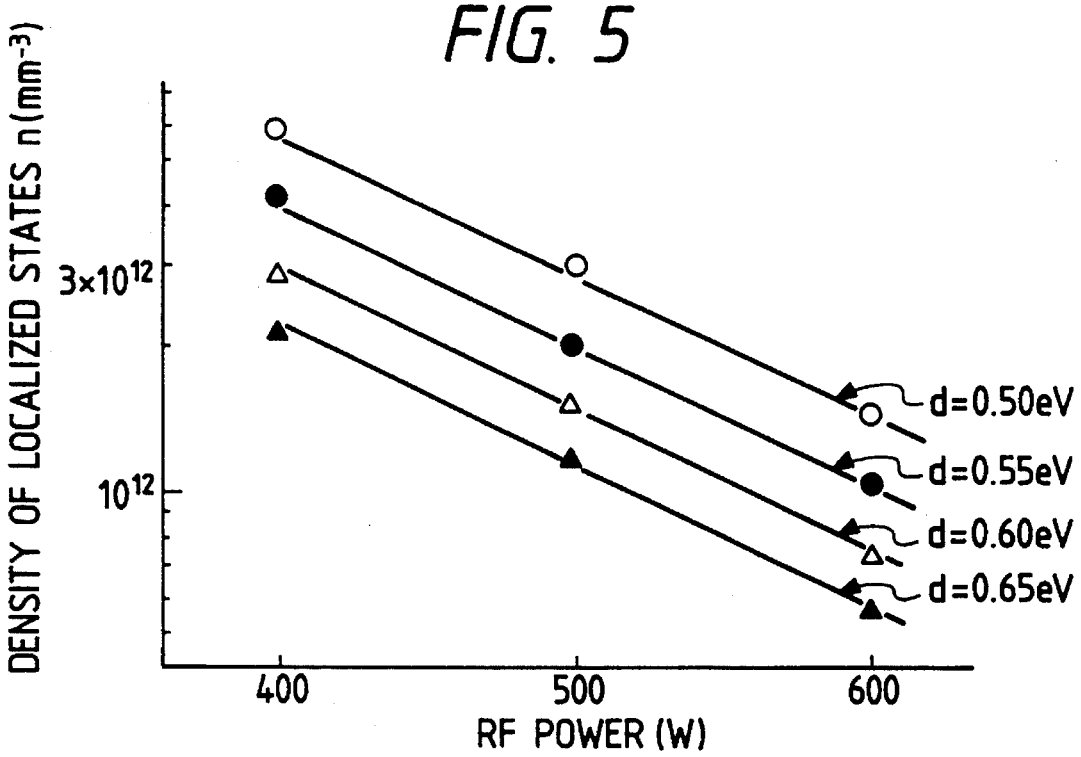
FIG. 5 is a chart showing the relation between the RF power in CPM measurement of samples and the localized energy level density n.

FIG. 5 shows the relationship between the RF power at the substrate temperature of 290° C. and the localized level density n. The density n tends to decrease with the increase in the RF power.

[Experimental Example 2]

Photosensitive members of a structure shown in FIG. 1 were prepared by RF-PCVD method. Said photosensitive members were prepared by laminating, on a photoconductive substrate, in succession a boron-doped charge injection blocking layer (a-Si:B 3 μm), a photoconductive layer (a-Si 25.5 μm) and a surface layer (a-SiC 0.5 μm).

Basic conditions for preparation of the charge injection blocking layer consisted of the use of $H_2$, $B_2H_6$, $SiH_4$ and NO mixed so as to attain ratios of $H_2/SiH_4$=4.0, $B_2H_6/SiH_4$= 1500 ppm and $NO/SiH_4$= 0.33; an internal pressure of the reaction chamber of 0.45 Torr; a substrate temperature of 290° C.; an RF power of 100 W; and a deposition rate of 6.4 Å/sec.

Basic conditions for preparation of the photoconductive layer consisted of the use of $H_2$, $B_2H_6$ and $SiH_4$ mixed so as to attain ratios of $H_2/SiH_4$=1.7 and $B_2H_6/SiH_4$=0.55 ppm; an internal pressure of the reaction chamber of 0.57 Torr; a substrate temperature of 290° C.; an RF power of 500 W; and a deposition rate of 22.4 Å/sec.

Basic conditions for preparation of the surface layer consisted of a ratio of $CH_4/SiH_4$ varied within a range of 4.0 to 45.7; an internal pressure of the reaction chamber of 0.45 Torr; a substrate temperature of 290° C.; an RF power of 120 W; and a deposition rate of 1.9 Å/sec.

In this example, the photoconductive layer alone was prepared under the same film forming conditions as those in the experimental example 1, with the variation of the RF power within a range of 400 to 600 W as in the experimental example 1. Other film forming conditions were selected same as the basic conditions.

On each of thus prepared photosensitive members, the correlation between the parameters n, E, S and the photomemory potential (Vm) or the image, by varying the electric field, applied to the photosensitive member, within a range of $1.0\times10^4$ to $2.0\times10^4$ V/mm and the surface moving speed S of the photosensitive member within a range of 200 to 600 mm/sec.

Figure 6:
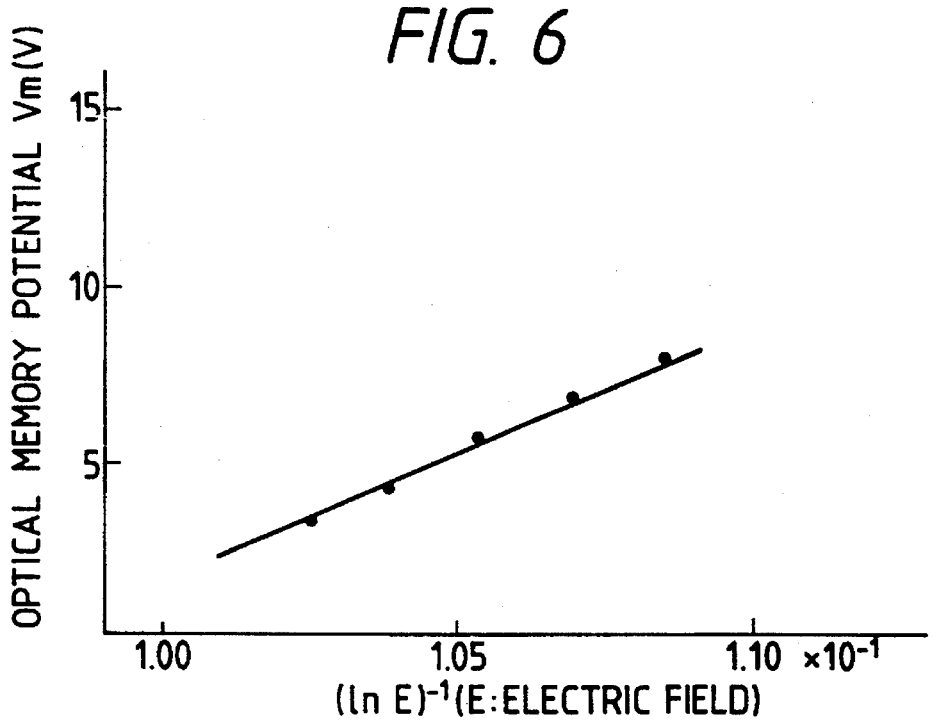
FIG. 6 is a chart showing the relation between the electric field E applied to the a-Si photosensitive member and the photomemory potential Vm.
Figure 7:
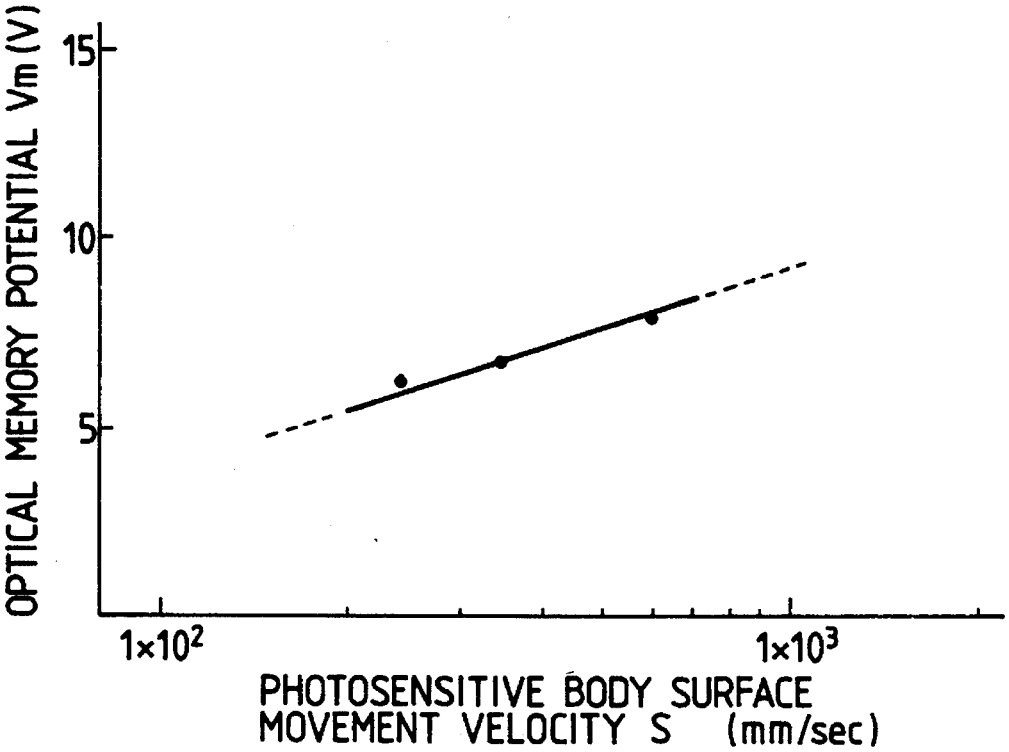
FIG. 7 is a chart showing the relation between the moving speed S of the surface of the a-Si photosensitive member and the photomemory potential Vm.
Figure 8:
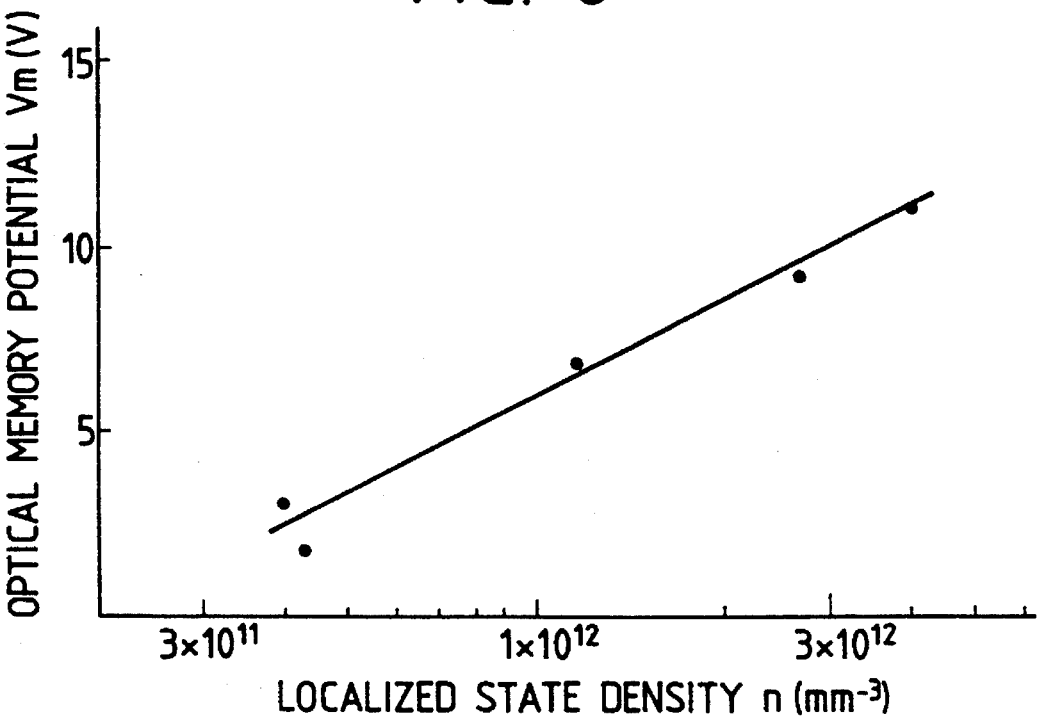
FIG. 8 is a chart showing the relation between the localized level density n in the photoconductive layer of the a-Si photosensitive member and the photomemory potential Vm.

FIG. 6 shows the relationship between E and Vm in case of n=1.8E12 and S=300; FIG. 7 shows the relationship between S and Vm in case of n=1.8E12 and E=1.3E4; and FIG. 8 shows the relationship between n and Vm in case of E=1.3E4 and S=300.

Based on the results of these measurements, it has been found that an image of high quality without the photomemory effect can be obtained, in a photosensitive member of the conventional layer configuration, by increasing the RF power at the formation of the photoconductive Layer and/or increasing the applied electric field E and/or decreasing the moving speed S of the photosensitive member.

Figure 9:
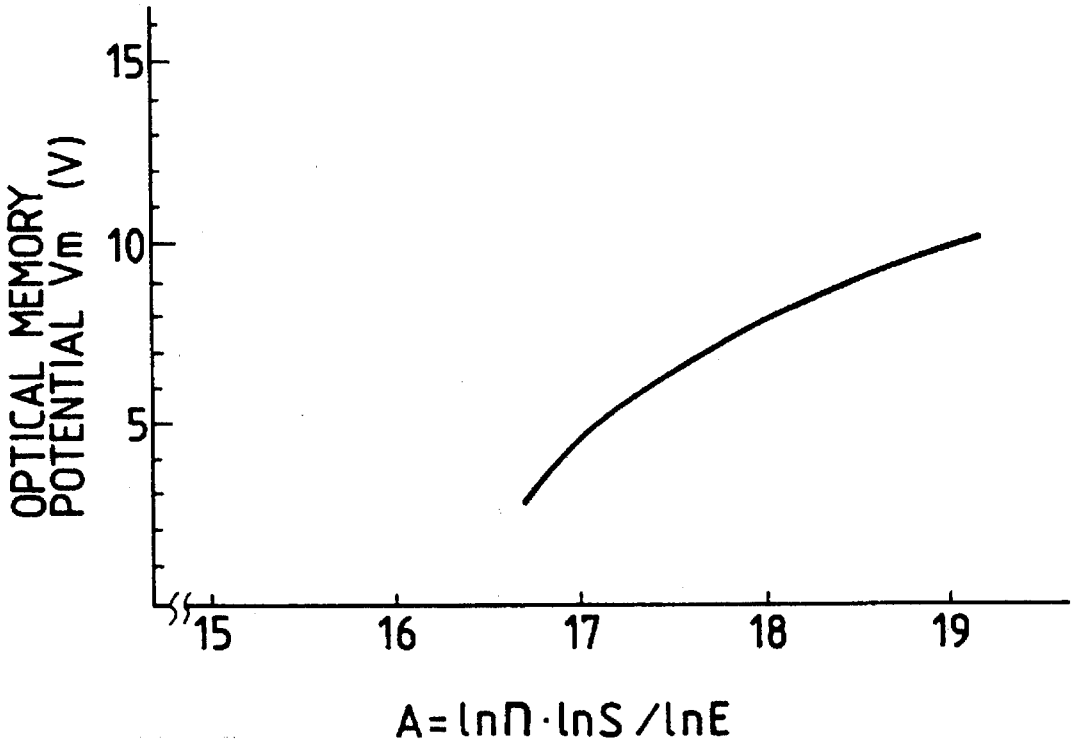
FIG. 9 is a chart showing the relation between the value A of the equation (1) characterizing the present invention and the photomemory potential Vm.

Relation between the value A of the equation (1) (i.e. parameters n, S and E) and the photomemory potential Vm, as shown in FIG. 9, has been obtained from experiments similar to those in the foregoing experimental examples 1 and 2 but based on a larger number of combinations of n, S and E. The photomemory potential Vm tends to decrease with the decrease in the value A of the equation (1).

It has also been found, from the experimental example 2, that a good image in which the photomemory is alleviated than in the prior art can be obtained when the photomemory potential Vm, determined in said experimental example, is 10 V or less; also a very good image in which the photomemory effect is negligible can be obtained when Vm is 7 V is less; and an excellent image in which the photomemory effect is not perceivable can be obtained when Vm is 5 V or less.

Stated differently, there can be obtained an electrophotographic apparatus of very high quality without the photomemory effect when the minimum of the value A of the equation (1) is 19.0 or less, preferably 18.0 or less and most preferably 17.0 or less. In the following the equation (1) is cited again:

$$A=\ln(n)\cdot\ln(S)/\ln(E) \quad (1)$$

wherein:

density ($mm^{-3}$) of localized energy levels within a range d–0.95 eV in the photoconductive layer;

d: energy depth (eV) of possible thermal excitation of carriers within the time of movement of a given part of the photosensitive member from the source of photomemory (image exposure or blank exposure) to the main charger (in case of plural photomemory sources, the smaller one being taken);

E: electric field (V/mm) applied to the photosensitive member; and

S: moving speed (mm/sec) of the surface of the photosensitive member.

In the present experimental example, at the film formation of the sample or the photosensitive member, the RF power was varied in order to control the localized energy level density n, but such control can naturally be attained also by other parameters such as substrate temperature or deposition rate.

[EXAMPLES]

Now the present invention will be clarified further by examples to be explained in the following with reference to the attached tables and drawings, but the present invention is naturally not limited to such examples but can be realized in any form that can attain the objects of the present invention.

In the following examples, the film-forming conditions in the photosensitive member preparation are same as the basic conditions explained in the experimental example 2, unless otherwise described.

[Example 1]

A photosensitive member was prepared employing an RF power of 600 W and a substrate temperature of 315° C. in the preparation of the photoconductive layer. A very good result was obtained in the measurement of Vm and image, employing an electric field $E=1.3\times10^4$ V/mm applied to said photosensitive member and a moving speed S=450 mm/sec. of said photosensitive member. The obtained results are shown in Table 1.

[Example 2]

A photosensitive member was prepared employing an RF power of 500 W and a substrate temperature of 290° C. in the preparation of the photoconductive layer. A very good result was obtained in the measurement of Vm and image, employing an electric field $E=2.7\times10^4$ V/mm applied to said photosensitive member and a moving speed S=450 mm/sec. thereof. The obtained results are shown in Table 1.

[Example 3]

A photosensitive member was prepared employing an RF power of 500 W and a substrate temperature of 290° C. in the preparation of the photoconductive layer. A good result was obtained in the measurement of Vm and image, employing an electric field $E=1.3\times10^4$ V/mm applied to said photosensitive member and a moving speed S=450 mm/sec. thereof. The obtained results are shown in Table 1.

[Example 4]

A photosensitive member was prepared employing an RF power of 400 W and a substrate temperature of 280° C. in the preparation of the photoconductive layer. A good result was obtained in the measurement of Vm and image, employing an electric field $E=1.3\times10^4$ V/mm applied to said photosensitive member and a moving speed S=300 mm/sec. thereof. The obtained results are shown in Table 1.

[Example 5]

A photosensitive member was prepared employing an RF power of 400 W and a substrate temperature of 280° C. in the preparation of the photoconductive layer. A good result was obtained in the measurement of Vm and image, employing an electric field $E=2.7\times10^4$ V/mm applied to said photosensitive member and a moving speed S=450 mm/sec. thereof. The obtained results are shown in Table 1.

[Example 6]

A photosensitive member was prepared employing aluminum (Al) mixed with a ratio Al/Si=1.1 ppm instead of boron (B), an RF power of 500 W and a substrate temperature of 290° C. A good result was obtained in the measurement of Vm and image, employing an electric field E=1.3×$10^4$ V/mm applied to said photosensitive member and a moving speed S=450 mm/sec. thereof. The obtained results are shown in Table 1.

[Example 7]

A photosensitive member was prepared employing an RF power of 500 W and a substrate temperature of 290° C. A good result was obtained in the measurement of Vm and image, employing an electric field E=1.3×$10^4$ V/mm applied to said photosensitive member and a moving speed S=600 mm/sec. thereof. The obtained results are shown in Table 1.

[Reference Example 1]

A photosensitive member was prepared employing an RF power of 500 W and a substrate temperature of 290° C. Photomemory effect was observed in the measurement of Vm and image, employing an electric field E=6.7×$10^3$ V/mm applied to said photosensitive member, and a moving speed S=450 mm/sec. thereof. The obtained results are shown in Table 1.

[Reference Example 2]

A photosensitive member was prepared employing an RF power of 400 W and a substrate temperature of 280° C. Photomemory effect was observed in the measurement of Vm and image, employing an electric field E= 1.3×$10^4$ V/mm applied to said photosensitive member, and a moving speed S=450 mm/sec. thereof. The obtained results are shown in Table 1.

[Reference Example 3]

A photosensitive member was prepared employing an RF power of 400 W and a substrate temperature of 280° C. Photomemory effect was observed in the measurement of Vm and image, employing an electric field E= 6.7×$10^3$ V/mm applied to said photosensitive member, and a moving speed S=450 mm/sec. thereof. The obtained results are shown in Table 1.

[Reference Example 4]

A photosensitive member was prepared employing an RF power of 400 W and a substrate temperature of 280° C. Photomemory effect was observed in the measurement of Vm and image, employing an electric field E= 1.3×$10^4$ V/mm applied to said photosensitive member, and a moving speed S = 600 mm/sec. thereof. The obtained results are shown in Table 1.

[Reference Example 5]

A photosensitive member was prepared employing a ratio C/Si=2%, an RF power of 500 W and a substrate temperature of 290° C. Photomemory effect was observed in the measurement of Vm and image, employing an electric field E=1.3×$10^4$ V/mm applied to said photosensitive member, and a moving speed S=450 mm/–sec. thereof. The obtained results are shown in Table 1.

[Reference Example 6]

A photosensitive member was prepared employing Al mixed in a ratio of Al/Si=5.0 ppm instead of boron (B), an RF power of 500 W and a substrate temperature of 290° C. A high quality image was obtained in the measurement of Vm and image, employing an electric field E=1.3×$10^4$ V/mm applied to said photosensitive member, and a moving speed S=450 mm/sec. thereof, but the charging efficiency was lowered. The obtained results are shown in Table 1.

[Reference Example 7]

A photosensitive member was prepared employing $B_2H_6$ mixed with a ratio B/Si=4.2 ppm, an RF power of 500 W and a substrate temperature of 290° C. A high quality image was obtained but the charging efficiency was lowered, in the measurement of Vm and image employing an electric field E=1.3×$10^4$ V/mm applied to said photosensitive member, and a moving speed S=450 mm/sec. thereof. The obtained results are shown in Table 1.

Also the dependences on S, E and n are respectively shown in Tables 2, 3 and 4.

In the foregoing examples and reference examples, the RF power and the substrate temperature were varied in order to control the value A of the photoconductive layer, but such control may also be attained by other means such as the deposition rate.

[Brief Description of the Tables]

Table 1 described as below shows the results of measurements and evaluation of the photosensitive members prepared in the Examples 1 to 7 and the Reference Examples 1 to 7.

Table 2 described as below shows the results of measurements and evaluation (dependence on the surface moving speed S of the photosensitive member) of the photosensitive members of the foregoing examples and reference examples.

Table 3 described as below shows the results of measurements and evaluation (dependence on the electric field E applied to the photosensitive member) of the photosensitive members of the foregoing examples and reference examples.

Table 4 described as below shows the results of measurements and evaluation (dependence on the localized energy level density n in the photoconductive layer of the photoconductive member) of the photosensitive members in the foregoing examples and reference examples.

The symbols used in Tables 1 to 4 have the following meanings:

* excellent
⊙ very good
O good
Δ fair
X deteriorated

TABLE 1

| | (W) RF power | Substrate temperature | ($mm^{-3}$) n | (mm/sec) S | (V/mm) E | A | (V) Vm | Image | Charging efficiency | Potential shift | Overall evaluation | (%) C/Si | (ppm) M/Si | Remarks |
|---|---|---|---|---|---|---|---|---|---|---|---|---|---|---|
| Example 1 | 600 | 315 | 3.0E11 | 450 | 1.3E4 | 17.04 | 5.0 | * | o | o | * | | 1.1 | |
| 2 | 500 | 290 | 1.6E12 | 450 | 2.7E4 | 16.83 | 3.5 | * | o | o | * | | 1.1 | |
| 3 | 500 | 290 | 1.6E12 | 450 | 1.3E4 | 18.12 | 7.0 | ⊙ | o–Δ | o | ⊙ | | 1.1 | |
| 4 | 400 | 280 | 1.4E13 | 300 | 1.3E4 | 18.23 | 7.5 | ⊙ | o | o | ⊙ | | 1.1 | |
| 5 | 400 | 280 | 1.4E13 | 450 | 2.7E4 | 18.12 | 7.0 | ⊙ | o–Δ | o | ⊙ | | 1.1 | |
| 6 | 500 | 290 | 1.6E12 | 450 | 1.3E4 | 18.12 | 9.5 | o–Δ | Δ | o | o | | 1.1 | *M = Al |
| 7 | 500 | 290 | 1.6E12 | 600 | 1.3E4 | 18.98 | 9.0 | o | o–Δ | o | o | | 1.1 | |

TABLE 1-continued

| | (W) RF power | Substrate temperature | ($mm^{-3}$) n | (mm/sec) S | (V/mm) E | A | (V) Vm | Image | Charging efficiency | Potential shift | Overall evaluation | (%) C/Si | (ppm) M/Si | Remarks |
|---|---|---|---|---|---|---|---|---|---|---|---|---|---|---|
| Reference Example 1 | 500 | 290 | 1.6E12 | 450 | 6.7E3 | 19.49 | 12.5 | o–Δ | Δ | Δ | Δ | | 1.1 | |
| 2 | 400 | 280 | 1.4E13 | 450 | 1.3E4 | 19.52 | 13.0 | o–Δ | Δ | Δ | Δ | | 1.1 | |
| 3 | 400 | 280 | 1.4E13 | 450 | 6.7E3 | 20.99 | 15.5 | Δ | Δ | Δ | Δ | | 1.1 | |
| 4 | 400 | 280 | 1.4E13 | 600 | 1.3E4 | 20.44 | 15.0 | Δ | o–Δ | Δ | Δ | | 1.1 | |
| 5 | 500 | 290 | 5.0E13 | 450 | 1.3E4 | 20.34 | 15.0 | o–Δ | Δ | Δ | Δ | 2.0 | | 1.1 |
| 6 | 500 | 290 | 3.0E12 | 450 | 1.3E4 | 18.53 | 8.5 | o | X | o | Δ | | 5.0 | *M = Al |
| 7 | 500 | 290 | 1.7E12 | 450 | 1.3E4 | 18.16 | 3.5 | * | X | Δ | Δ | | 4.2 | |

TABLE 2

| | (W) RF power | Substrate temperature | ($mm^{-3}$) n | (mm/sec) S | (V/mm) E | A | (V) Vm | Image | Charging efficiency | Potential shift | Overall evaluation |
|---|---|---|---|---|---|---|---|---|---|---|---|
| Example 2 | 500 | 290 | 1.6E12 | 450 | 2.7E4 | 16.83 | 3.5 | * | o | o | * |
| 3 | 500 | 290 | 1.6E12 | 450 | 1.3E4 | 18.12 | 7.0 | ⊙ | o–Δ | o | ⊙ |
| 7 | 500 | 290 | 1.6E12 | 600 | 1.3E4 | 18.98 | 9.0 | o | o–Δ | o | o |
| Example 4 | 400 | 280 | 1.4E13 | 300 | 1.3E4 | 18.23 | 7.5 | ⊙ | o | o | ⊙ |
| Reference Example 2 | 400 | 280 | 1.4E13 | 450 | 1.3E4 | 19.52 | 13.0 | o–Δ | Δ | Δ | Δ |
| 4 | 400 | 280 | 1.4E13 | 600 | 1.3E4 | 20.44 | 15.0 | Δ | o–Δ | Δ | Δ |

TABLE 3

| | (W) RF power | Substrate temp. | ($mm^{-3}$) n | (mm/sec) S | (V/mm) E | A | (V) Vm | Image | Charging efficiency | Potential shift | Overall evaluation |
|---|---|---|---|---|---|---|---|---|---|---|---|
| Example 2 | 500 | 290 | 1.6E12 | 450 | 2.7E4 | 16.83 | 3.5 | * | o | o | * |
| 3 | 500 | 290 | 1.6E12 | 450 | 1.3E4 | 18.12 | 7.0 | ⊙ | o–Δ | o | ⊙ |
| Ref. Ex. 1 | 500 | 290 | 1.6E12 | 450 | 6.7E3 | 19.49 | 12.5 | o–Δ | Δ | Δ | Δ |
| Example 5 | 400 | 280 | 1.4E13 | 450 | 2.7E4 | 18.12 | 7.0 | ⊙ | o–Δ | o | ⊙ |
| Ref. Ex. 2 | 400 | 280 | 1.4E13 | 450 | 1.3E4 | 19.52 | 13.0 | o–Δ | Δ | Δ | Δ |
| 3 | 400 | 280 | 1.4E13 | 450 | 6.7E3 | 20.99 | 15.5 | Δ | Δ | Δ | Δ |

TABLE 4

| | (W) RF power | Substrate temp. | ($mm^{-3}$) n | (mm/sec) S | (V/mm) E | A | (V) Vm | Image | Charging efficiency | Potential shift | Overall evaluatn. | Remarks |
|---|---|---|---|---|---|---|---|---|---|---|---|---|
| Example 1 | 600 | 315 | 3.0E11 | 450 | 1.3E4 | 17.04 | 5.0 | * | o | o | * | |
| 3 | 500 | 290 | 1.6E12 | 450 | 1.3E4 | 18.12 | 7.0 | ⊙ | o | o | ⊙ | |
| 4 | 400 | 280 | 1.4E13 | 300 | 1.3E4 | 18.23 | 7.5 | ⊙ | o | o | ⊙ | |
| 6 | 500 | 290 | 1.6E12 | 450 | 1.3E4 | 18.12 | 9.5 | o–Δ | o | o | o–Δ | *Image defects other than photo-memory |
| Ref. Ex 2 | 400 | 280 | 1.4E13 | 450 | 1.3E4 | 19.52 | 13.0 | o–Δ | Δ | Δ | Δ | |
| 5 | 500 | 290 | 5.0E13 | 450 | 1.3E4 | 20.34 | 15.0 | o–Δ | Δ | Δ | Δ | *Sensitivity deteriorated |
| 6 | 500 | 290 | 3.0E12 | 450 | 1.3E4 | 18.53 | 8.5 | o | X | X | Δ | |
| 7 | 500 | 290 | 1.7E12 | 450 | 1.3E4 | 18.16 | 3.5 | ⊙ | X | Δ | o–Δ | |

[Example 8]

When the use of a specified a-Si photosensitive member is decided, it is possible to regulate or control the electrophotographic apparatus according to the aforementioned equation (1) thereby providing an electrophotographic apparatus capable of image recording of high quality.

Figure 10:
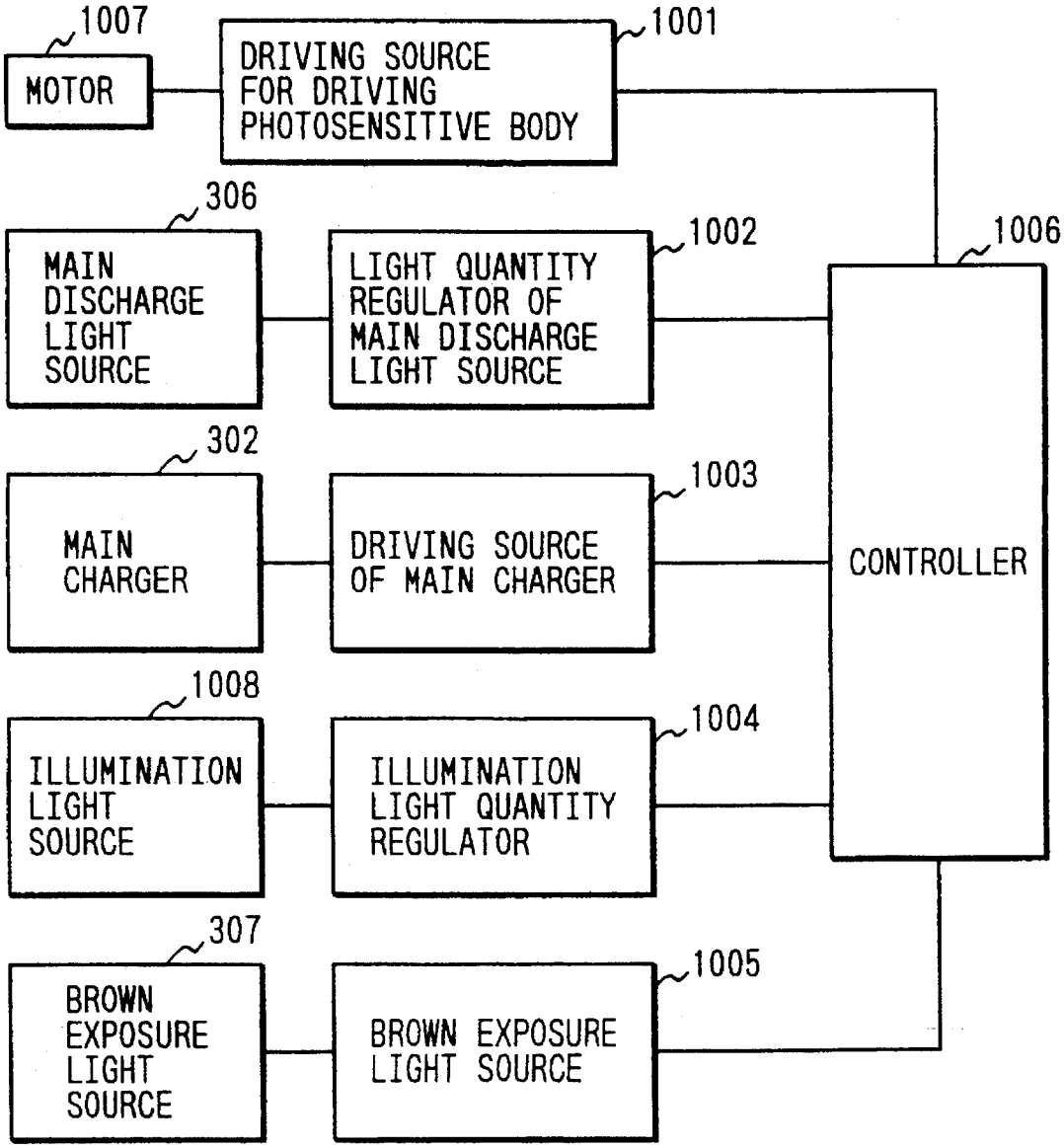
FIG. 10 is a block diagram of a preferred embodiment of the electrophotographic apparatus of the present invention.

FIG. 10 shows an example of the configuration of the electrophotographic apparatus.

In FIG. 10 there are provided a drive source 1001 for the-photosensitive member, such as a driver for a motor 1007 for rotating the a-Si photosensitive member at a desired speed; a light amount regulator 1002 for regulating the light amount of a main charge eliminating light source 306, composed advantageously of a voltage regulator or a pulse generator; a main charger drive source 1003 for driving a main charger 302; an exposing light amount regulator 1004 for an original illuminating light source or a photosensitive member exposing light source for the image information exposure 303 for example by light reflected from the original, information-bearing laser light or light from an LED light source; a blank exposure regulator 1005 for regulating the light amount of a blank exposure light source 307; and a controller 1006 for controlling the above-mentioned units. Said controller 1006 may be provided in the CPU of the main apparatus, or independently therefrom, or may be provided respectively in the drive sources and regulators mentioned above.

The appropriate setting of the above-mentioned drive sources ant regulators may be achieved, for example, by entering information relative to the a-Si photosensitive member into the controller 1006.

In the actual apparatus, various additional devices such as recording sheet detecting means for measuring the timing of blank exposure or a motor for transporting the recording sheet, may also be connected to the controller 1006.

Otherwise, the respective regulators may be independently adjusted according to the equation (1) and matching the a-Si photosensitive member to be employed.

Naturally the configuration shown in FIG. 10 represents a mere example, and any other configuration may be employed as long as the parameters relating to the electrophotographic apparatus itself in the equation (1), such as the electric field E and the surface moving speed S of the photosensitive member, can be regulated when required.

In this manner, even when the a-Si photosensitive member fluctuates in performance between different lots, is replaced or is varied in design specifications, the apparatus can be easily regulated according to the equation (1), whereby the service life of the apparatus can be extended.

As explained in the foregoing, the present invention provides the following advantages.

The a-Si photosensitive member of the present invention can provide an electrophotographic apparatus capable of image formation of overall high quality without photomemory effect and without deterioration of the charging efficiency, by controlling the aforementioned parameters n, d, E and S in such a manner that a value A, given by the equation (1) defined by the localized energy level density n in the photoconductive layer of the photosensitive member, the electric field E and the surface moving speed S of the photosensitive member, becomes equal to or less than 19.0.

Particularly a photoconductive layer, constructed with a single-layered structure as shown in FIG. 1, can attain the objects of the present invention and can at the same time achieve even improved performances.

Also as the performance can be investigated with the sample, it is no longer necessary, as is conventionally done, to prepare the photosensitive member and to execute evaluation on an electrophotographic apparatus. There can be obtained the conditions for preparation of an ideal photosensitive member without photomemory effect, matching the conditions of use thereof such as electric field or rotating speed of the photosensitive member.

The present invention is also very effective in case of eliminating the photomemory effect in an a-Si photosensitive member of a different layer structure.

The present invention is furthermore effective in designing an electrophotographic apparatus matching the given photosensitive member.

What is claimed is:

1. An electrophotographic apparatus employing:

(a) a photosensitive member provided with at least an amorphous photoconductive layer containing at least silicon, atoms of Group III of the Periodic Table in amounts not exceeding 4.0 ppm and at least one of hydrogen and halogen atoms;

(b) at least one of a main charge eliminating light source, a main charger, an image exposure light source and a blank exposure light source; and (c) means for increasing the mobility of photocarriers in the photosensitive member to reduce photomemory effect comprising means for driving the photosensitive member and means for applying an electric field to the photosensitive member in accordance with the following equation (1):

$$A=\ln(n)\cdot\ln(S)/\ln(E) \quad (1)$$

wherein:

n: density in $mm^{-3}$ of localized energy levels within a range d–0.95 eV in the photoconductive layer;

d: energy depth in eV of possible thermal excitation of carriers within the time of movement of a given part of the photosensitive member from the source of photomemory whether image exposure or blank exposure to the main charger, wherein in case of plural photomemory sources, the smaller one being taken;

E: electric field in V/mm applied to the photoconductive member;

S: moving speed in mm/sec of the surface of the photosensitive member; and

A is 19.0 or less.

2. An electrophotographic apparatus according to claim 1, wherein said photoconductive layer contains carbon atoms with a content not exceeding 1%.

3. An electrophotographic apparatus according to claim 1, wherein the atoms of the Group III of the Periodic Table are boron atoms.

4. An electrophotographic apparatus according to claim 1, further comprising a motor for driving said photosensitive member, and a photosensitive member driving source for driving said motor.

5. An electrophotographic apparatus according to claim 1, further comprising a regulator for regulating the light amount of said main charge eliminating light source.

6. An electrophotographic apparatus according to claim 1, further comprising a driving source for driving said main charger.

7. An electrophotographic apparatus according to claim 1, further comprising a regulator for regulating the light amount of said exposure light source.

8. An electrophotographic apparatus according to claim 1, further comprising a regulator for regulating the light amount of said blank exposure light source.

9. An electrophotographic apparatus according to claim 1, further comprising a motor for driving said photosensitive member; a photosensitive member driving source for driving said motor; a driving source for driving said main charger; and at least a regulator selected from a regulator for regulating the light amount of said main charge eliminating light source, a regulator for regulating the light amount of said exposure light source, and a regulator for regulating the light amount of said blank exposure light source; and a controller for controlling at least one of said photosensitive member driving source, said main charger driving source and said selected at least one regulator.

10. An electrophotographic process comprising;

(a) utilizing a photosensitive member provided with at least an amorphous photoconductive layer containing at least silicon, atoms of Group III of the Periodic Table in amounts not exceeding 4.0 ppm and at least one of hydrogen and halogen atoms;

(b) effecting at least one of main charge eliminating exposure, main charging, image exposure and blank exposure in this order; and (c) conducting image recording to increase the mobility of photocarriers in the photosensitive member to reduce photomemory effect such that a value A given by the following equation (1) becomes equal to 19.0 or less:

$$A=\ln(n)\cdot\ln(S)/\ln(E) \quad (1)$$

wherein:

n: density in $mm^{-3}$ of localized energy levels within a range d–0.95 eV in the photoconductive layer;

d: energy depth in eV of possible thermal excitation of carriers within the time of movement of a given part of the photosensitive member from the source of photomemory whether image exposure or blank exposure to the main charger, wherein in case of plural photomemory sources, the smaller one being taken;

E: electric field in V/mm applied to the photoconductive member; and

S: moving speed in mm/sec of the surface of the photosensitive member.

* * * * *

UNITED STATES PATENT AND TRADEMARK OFFICE

CERTIFICATE OF CORRECTION

PATENT NO. : 5,480,750

DATED : January 2, 1996

INVENTOR(S) : MASAYA KAWADA ET AL.

It is certified that error appears in the above-indentified patent and that said Letters Patent is hereby corrected as shown below:

On the title page item,

[57] ABSTRACT

Line 13, "within" should read --and without--.

COLUMN 2

Line 1, "surface charged" should read --surface-charged--;
Line 36, "charge-ability" should read --chargeability--;
Line 46, "periodic table," should read --Periodic Table,--.

COLUMN 5

Line 51, "gasses" should read --gases--.

COLUMN 7

Line 34, "Layer" should read --layer--.
Line 64, "density" should read --n: density--.

UNITED STATES PATENT AND TRADEMARK OFFICE

CERTIFICATE OF CORRECTION

PATENT NO. : 5,480,750

DATED : January 2, 1996

INVENTOR(S) : MASAYA KAWADA ET AL.

It is certified that error appears in the above-indentified patent and that said Letters Patent is hereby corrected as shown below:

COLUMN 10

Line 1, "S=450mm/-sec." should read --S=450mm/sec.--.

COLUMN 11

Table-1 continued, "2.0 1.1" should read --2.0 1.1--.

COLUMN 13

Line 6, "the-photosensitive" should read --the photosensitive--;
Line 26, "ant" should read --and--.

Signed and Sealed this

Thirtieth Day of April, 1996

Bruce Lehman

*Attest:*

BRUCE LEHMAN

*Attesting Officer*

*Commissioner of Patents and Trademarks*